US005951309A

United States Patent [19]

Hopper

[11] Patent Number: 5,951,309

[45] Date of Patent: Sep. 14, 1999

[54] RECEPTACLE ASSEMBLY HAVING POSITION RETENTION TABS

[75] Inventor: Douglas A. Hopper, Maryville, Ill.

[73] Assignee: Hubbell Incorporated, Orange, Conn.

[21] Appl. No.: 09/033,298

[22] Filed: Mar. 2, 1998

[51] Int. Cl.[6] ..... H01R 13/44

[52] U.S. Cl. ..... 439/142; 439/136

[58] Field of Search ..... 439/142, 135, 439/136

[56] References Cited

U.S. PATENT DOCUMENTS

| | | | |
|---|---|---|---|
| 3,195,095 | 7/1965 | Field | 339/16 |
| 3,633,150 | 1/1972 | Swartz | 339/36 |
| 3,950,055 | 4/1976 | Samuels et al. | 339/36 |
| 4,381,879 | 5/1983 | Ehrenfels et al. | 339/44 R |
| 4,902,238 | 2/1990 | Lacobucci | 439/135 |
| 5,571,023 | 11/1996 | Anthony | 439/142 |
| 5,573,412 | 11/1996 | Anthony | 439/133 |
| 5,582,521 | 12/1996 | Mori et al. | 439/142 |

*Primary Examiner*—Steven L. Stephan
*Assistant Examiner*—Chandrika Prasad
*Attorney, Agent, or Firm*—Jerry M. Presson; Michael R. Swartz

[57] ABSTRACT

A receptacle assembly includes a body adapted to receive a plug at one end, a cover, a hinge having a bifurcated end and pivotally mounting the cover to the body for movement between an open condition and a closed condition relative to the body and biasing the cover toward the closed condition, and position retention tabs formed on laterally spaced apart lugs defined on the bifurcated end of the hinge with each tab projecting outwardly therefrom and defining an arcuate-shaped shoulder such that the shoulders of the tabs and the body can retain a rod-shaped member therebetween for blocking movement of the cover from the open condition to the closed condition when the plug is not present at the one end of the body. The cover is also rotatable between an open position where the cover is removable from the body and a closed position where the cover is secured onto the body.

18 Claims, 3 Drawing Sheets

RECEPTACLE ASSEMBLY HAVING POSITION RETENTION TABS

BACKGROUND OF THE INVENTION

1. Field of the Invention

The present invention relates generally to electrical connectors of the type having plug and receptacle components for general and hazardous industrial applications and, more particularly, is concerned with a receptacle assembly having position retention tabs.

2. Description of the Prior Art

For many years a comprehensive selection of electrical products, namely, electrical fittings, enclosures, distribution equipment, connectors, controls and lighting fixtures, have been manufactured and sold by Killark Electric Manufacturing Company, a subsidiary of Hubbell Incorporated. These electrical products are designed for use in hazardous, hostile, corrosive and general industrial environments. More specifically, weather resistant electrical connectors having plugs and receptacles, are designed as general purpose equipment for use in and around industrial plants, both indoors and outdoors, on portable and stationary apparatuses.

In one particular design, the electrical connector receptacle has a body adapted to receive a plug at one end. The receptacle also has a cover pivotally mounted thereon adjacent to the one end and spring biased to move from an open position to a closed position when the plug is not present. In its open position, the cover is angularly displaced from the plug-receiving end of the receptacle allowing for mating of the plug with the receptacle end. In its closed position, with the plug removed from the receptacle, the cover engages and seals the open end of the receptacle so as to prevent water from entering electrical connections within the receptacle. Thus, the spring biasing or loading of the cover causes it to automatically close when the plug is removed.

Typically, an electrician needs to access the open end of the receptacle during the installation process in order to verify proper polarity, phasing and grounding of the electrical connections in the receptacle. The spring biased tendency of the cover to close on the receptacle end creates a problem for the electrician in the performance of the verification procedure. The electrician's job is made much more difficult in that he or she must hold the cover open with one hand and perform the verification tasks with the other hand.

Consequently, a need exists for further improvement of the design of receptacle assemblies to overcome the aforementioned problem.

SUMMARY OF THE INVENTION

The present invention provides a receptacle assembly designed to satisfy the aforementioned need. The receptacle assembly of the present invention allows an electrician to mechanically retain a cover of the assembly in an open condition in relation to a body of the assembly while servicing the receptacle assembly, such as during the installation process. Through the use of retention tabs of a pair of spaced apart lugs defined on a bifurcated end of a hinge of the assembly, the electrician may place an elongated rod-shaped member, such as a screwdriver or writing instrument, between the retention tabs and the body of the assembly to prevent the cover from moving to a closed condition when a plug is not present at one end of the body.

Accordingly, the present invention is directed to a receptacle assembly which comprises: (a) a body adapted to receive a plug at one end; (b) a cover; (c) a hinge pivotally mounting the cover to the body for movement between an open condition and a closed condition relative to the body and biasing the cover toward the closed condition; and (d) position retention means attached to the hinge for facilitating holding the cover adjacent to the open condition and blocking of movement of the cover to the closed condition when the plug is not present at the one end of the body.

More particularly, the hinge has a bifurcated end forming a pair of laterally spaced apart lugs. Each of the lugs has a tab projecting peripherally outwardly therefrom and defining a shoulder such that the shoulders of the tabs and the body can retain a rod-shaped member therebetween for holding the cover adjacent to the open condition and blocking movement of the cover to the closed condition when the plug is not present at the one end of the body. The body further has a hinge mounting portion being substantially cylindrical in shape and having an end defining a passageway therethrough. The hinge mounting portion has a spring disposed within the passageway thereof which is operable with the hinge for biasing the cover to the closed condition. Also, the body is substantially cylindrical in shape and the cover is substantially circular in shape and of a diameter slightly greater than the diameter of the body for fitting the cover onto the body. The cover is rotatable between an open position where the cover is removable from the body and a closed position where the cover is secured onto the body.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
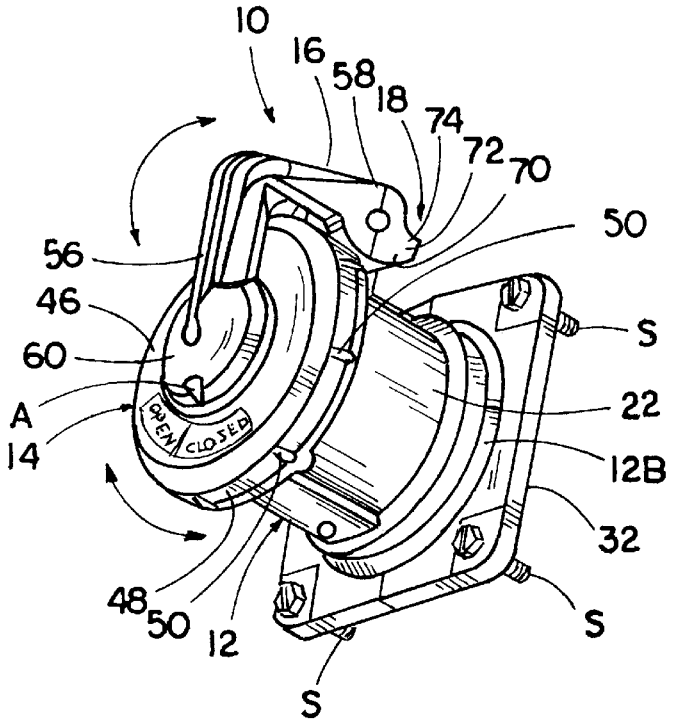
FIG. 1 is perspective view of a receptacle assembly of the present invention showing a cover of the assembly in a closed condition.

In the following description, like reference characters designate like or corresponding parts throughout the several views of the drawings. Also in the following description, it is to be understood that such terms as "forward", "rearward", "left", "right", "upwardly", "downwardly", and the like are words of convenience and are not to be construed as limiting terms.

Referring now to the drawings, and particularly to FIGS. 1 and 4 to 7, there is shown a receptacle assembly, generally designated 10, of the present invention. The receptacle assembly 10 basically includes a body 12 adapted to receive a plug (not shown) at one end 12A, a cover 14, a hinge 16 for pivotally mounting the cover 14 to the body 12 for movement between an open condition, shown in FIGS. 8 and 9, and a closed condition, shown in FIGS. 1 and 4 to 7, relative to the body 12 and for biasing the cover 14 toward the closed condition, and position retention means 18 attached to the hinge 16 for facilitating holding the cover 14 adjacent to the open condition and blocking of movement of the cover 14 to the closed condition when the plug is not present at the one end 12A of the body 12.

Referring now to FIGS. 1 to 9, the body 12 of the assembly 10 is substantially cylindrical in shape. The body 12 is open at the one or top end 12A and at an opposite or bottom end 12B and defines a passageway 12C therethrough extending between the top and bottom ends 12A, 12B. The body 12 may have a diameter at the one end 12A larger than at the opposite end 12B and of the same size as the diameter of the passageway 12C. The passageway 12C is provided for receiving any electrical assembly (not shown), such as a socket or the like, for making any suitable or desired electrical connection with a plug (not shown) inserted through the open end 12A when the cover 14 is in the open condition. The body 12 has an interior surface 20 and an exterior surface 22. The interior surface 20 defines a pair of opposite recesses 24 for mounting a pair of ground straps 26 thereto. The ground straps 26 are each mounted by a ground strap rivet 28 to the body 12 toward a lower end thereof. The diameter of the open bottom end 12B of the body 12 is smaller than the diameter of the open top end 12A by virtue of an interiorly extending ledge 30 which narrows the passageway 12C at the bottom end 12B. The exterior surface 22 defines a top ridge 22A surrounding the top end 12A of the body 12 and is smooth along a bottom ridge 22B surrounding the opposite end 12B of the body 12. A pair of indentations 22C are formed in the exterior surface 22 at the top ridge 22A thereon. A generally rectangular shaped base or flange 32 is connected to and surrounds the body 12 at its opposite end 12B and is provided with holes 32A at the corners of the flange 32. The flange 32 facilitates mounting the body 12 to a separate support structure (not shown). Mounting screws S are passed through respective ones of the mounting holes 32A for mounting of the base or flange 32, and thereby for mounting of the entire receptacle assembly 10, to any desired location.

Figure 3:
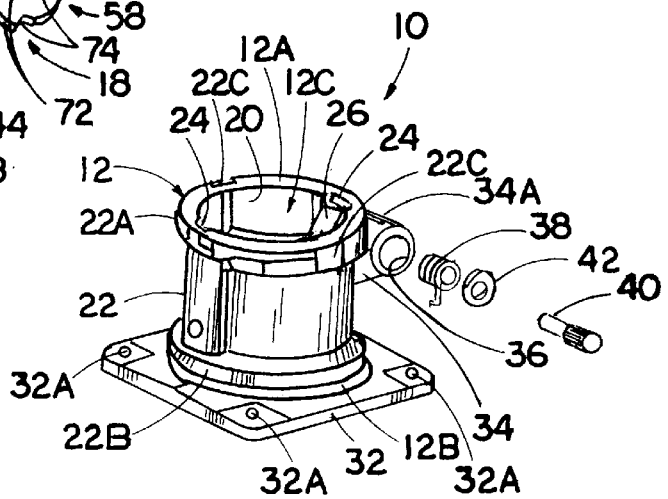
FIG. 3 is a perspective view of a body of the assembly showing a hinge mounting portion of the body exploded.

As best seen in FIG. 3, the body 12 of the assembly 10 further has a hinge mounting portion 34 which is substantially cylindrical in shape and has an end 34A defining an open passageway 36 therethrough. The hinge mounting portion 34 preferably is integrally connected to and extends outwardly from the body 12 between and spaced from the top and bottom ridges 22A, 22B (but closer to the top ridge 22A) on the exterior surface 22 of the body 12. The hinge mounting portion 34 has a spring 38 disposed within the passageway 36 thereof which is operable with the hinge 16 for biasing the cover 14 to the closed condition. The spring 38 is coiled and can be disposed on a spring guide 40. A hinge bushing 42 is disposed around an end of the spring guide 40 between the spring 38 and a portion of the hinge 16. One end of the spring guide 40 can be knurled for securing that end of the spring guide 40 to the hinge 16.

Figure 4:
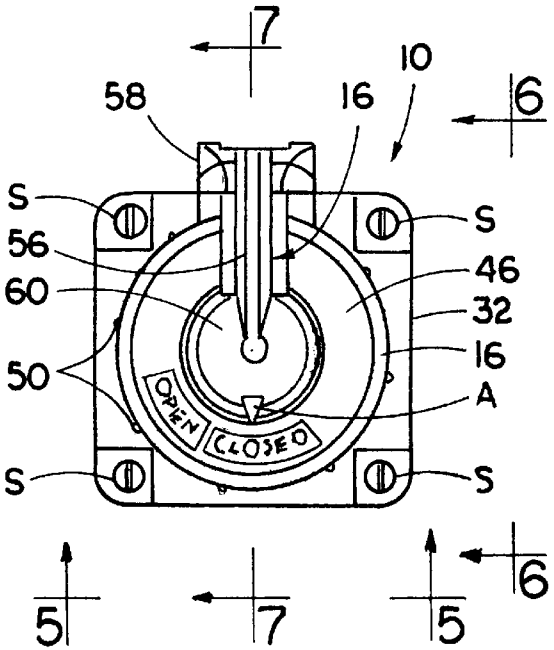
FIG. 4 is a top plan view of the assembly showing the cover in a closed position.

The cover 14 of the assembly 10 is substantially circular in shape. The cover 14 is rotatable between an open position, which permits the cover 14 to be removed from the body 12, and a closed position, where the cover 14 is secured onto the body 12. The cover 14 is in one or the other of the open and closed positions when the respective words "open" and "closed" formed thereon are aligned with a stationary arrowhead A on the hinge 16, as best seen in FIGS. 1 and 4. The cover 14 has a diameter slightly greater than the diameter of the body 12 at the top end 12A for fitting the cover 14 onto the body 12. The interior periphery of the cover 14 has a pair of protrusions 44 thereon which can be aligned with the indentations 22C defined on the top ridge 22A of the exterior surface 22 of the body 12 and then moved into an underlying relation to the top ridge 22A when the cover 14 is rotated relative to the body 12 so as to retain the cover 14 in the closed position. The cover 14 has a top wall 46 and a continuous side wall 48 which extends downwardly from the periphery of the top wall 46 and define the protrusions 44 interiorly on the side wall 48 which engage the top ridge 22A of the exterior surface 22 of the body 12 to retain the cover 14 in the closed position. The side wall 48 also has a plurality of spaced apart gripping ridges 50 formed along an exterior surface thereof for aiding a user in rotating the cover 14. The top wall 46 of the cover 14 defines a central hole 54 used in mounting of the cover 14 to the hinge 16. A flat gasket seal G is provided on the interior side of the top wall 46 of the cover 14 for forming a seal between the cover 14 and the top end 12A of the body 12 when the cover 14 is disposed in the closed position and condition relative thereto.

In its open condition, the cover 14 is angularly displaced from the plug-receiving end of the body 12 allowing for mating of the plug (not shown) with the electrical assembly disposed within the body 12. In its closed condition, with the plug removed from the body 12, the cover 14 engages and seals the open top end 12A of the body 12 so as to prevent water from entering electrical connections within the body 12. The spring biasing or loading of the cover 14 causes it to automatically close when the plug is removed.

Figure 2:
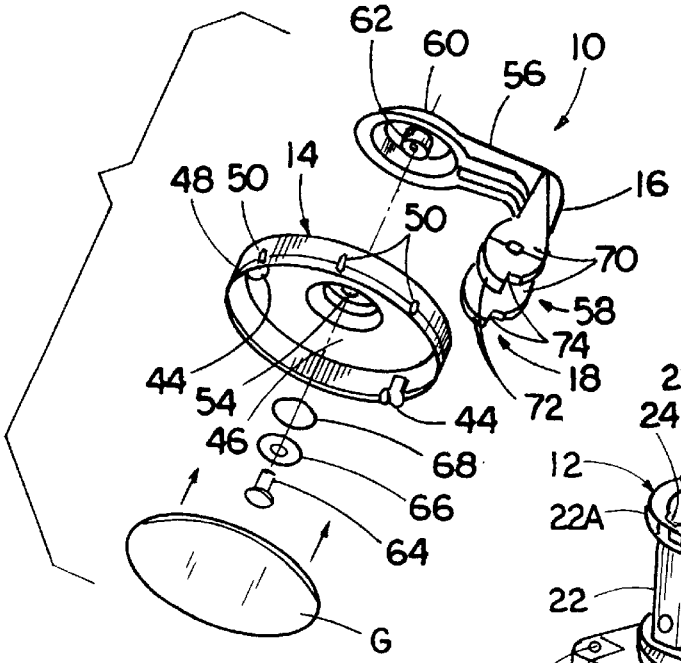
FIG. 2 is an exploded perspective view of the cover and a hinge of the receptacle assembly.

As seen in FIGS. 1, 2 and 6 to 9, the hinge 16 of the assembly 10 has a substantially L-shaped configuration with a pair of opposite upper and lower ends 56, 58. The upper end 56 is in the form of a substantially annular cap 60. The lower end 58 is bifurcated. The cap 60 is rotatably mounted to the top wall 46 of the cover 14. As best seen in FIG. 2, the cap 60 has a screw receptacle 62 formed on an underside thereof which is aligned with the central hole 54 of the top wall 46 of the cover 14. The cap 60 is then mounted to the top wall 46 of the cover 14 by a cover screw 64 inserted through a spring washer 66, a wave spring 68 and the central hole 54 of the top wall 46 of the cover 14 and into the screw receptacle 62 of the cap 60 of the hinge 16. The position retention means 18 are defined on the bifurcated end 58 of the hinge 16.

Figure 7:
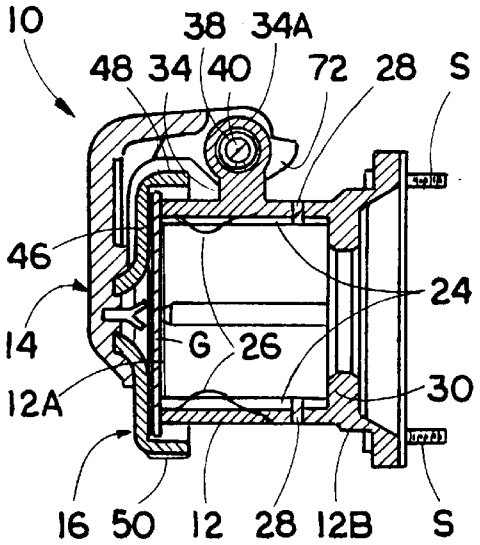
FIG. 7 is a sectional view of the assembly taken along line 7—7 of FIG. 4.
Figure 6:
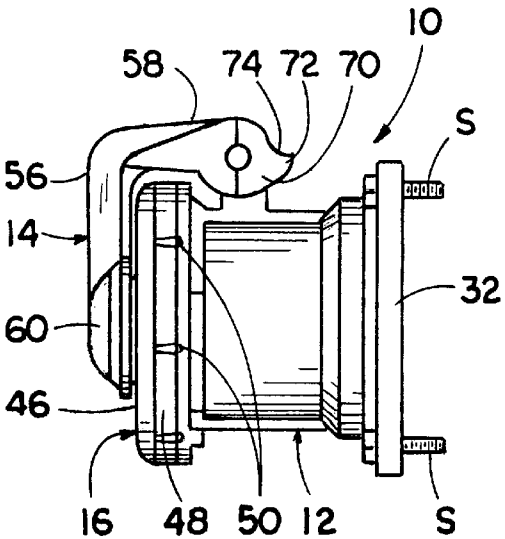
FIG. 6 is a side elevational view of the assembly as seen along line 6—6 of FIG. 4.
Figure 9:
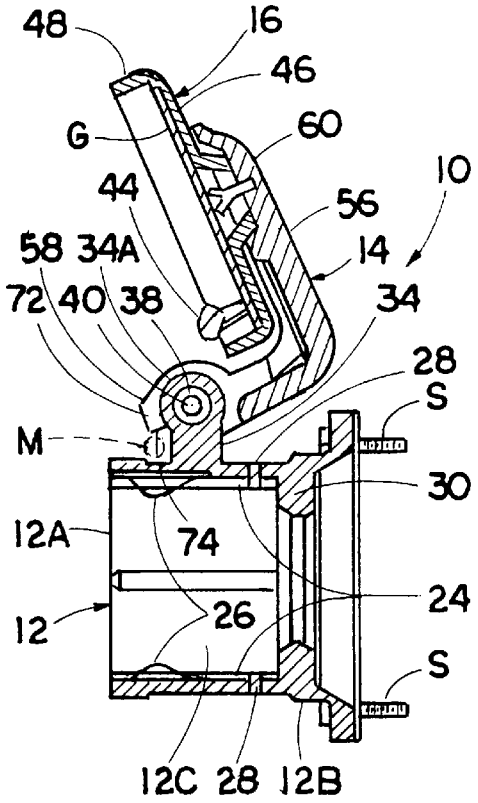
FIG. 9 is a sectional view of the assembly similar to that of FIG. 7, but showing the cover in the open condition.
Figure 8:
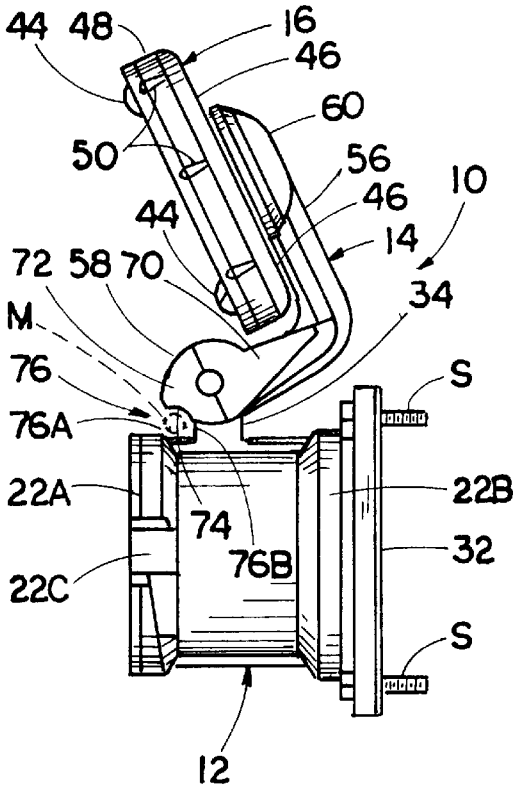
FIG. 8 is a side elevational view of the assembly similar to that of FIG. 6, but showing the cover in an open condition.
Figure 5:
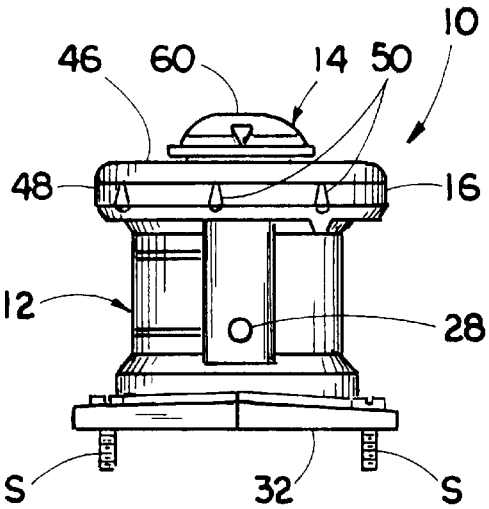
FIG. 5 is a front elevational view of the assembly as seen along line 5—5 of FIG. 4.

The bifurcated end 58 of the hinge 16 preferably takes the form of a pair of spaced apart lugs 70 and the position retention means 18 takes the form of at least one and preferably a pair of tabs 72 laterally spaced apart from one another, each projecting peripherally outwardly from one of the lugs 70 and defining a shoulder 74 such that the shoulders 74 on the tabs 72 and the adjacent portion of the body 12 may retain a rod-shaped member M (as shown in dotted outline in FIGS. 8 and 9), such as a screwdriver or pencil, therebetween for holding the cover 14 adjacent to the open condition and blocking and preventing movement of the cover 14 from the open condition to the closed condition when the plug is not present at the top end 12A of the body 12. The shoulders 74 preferably are relatively arcuate or concave in shape. As best seen in FIGS. 6 and 7, the shoulders 74 generally face away from the body 12 when the cover 14 is located at its closed condition. On the other hand, as best seen in FIGS. 8 and 9, the shoulders 74 generally face toward the body 12 when the cover 14 is located adjacent to its open condition. Also, the shoulders 74 in combination with the adjacent portion of the body 12 and the hinge mounting portion 34 form a channel-shaped gap 76 closed along a bottom 76A and open along a top 76B thereof for receiving and supporting the rod-shaped member M therein which, in turn, blocks pivotal movement of the hinge 16 and thereby the cover 14 to the closed condition.

It is thought that the present invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

I claim:

1. A receptacle assembly, comprising:

(a) a body adapted to receive a plug at one end of said body;

(b) a cover;

(c) a hinge pivotally mounting said cover to said body for undergoing movement between an open condition and a closed condition relative to said body and biasing said cover toward said closed condition; and (d) position retention means attached to said hinge for facilitating blocking of movement of said cover to said closed condition when the plug is not present at said one end of said body, said position retention means in conjunction with said hinge and an adjacent portion of said body form a channel-shaped cap closed along a bottom and open alone a top thereof for receiving and supporting a rod-shaped member therein which, in turn, blocks pivotal movement of said hinge and thereby said cover to said closed condition.

2. The assembly as recited in claim 1, wherein said position retention means also is for facilitating holding said cover adjacent to said open condition.

3. The assembly as recited in claim 1, wherein said body is substantially cylindrical in shape and said cover is substantially circular in shape and has a diameter slightly greater than a diameter of said body for fitting said cover onto said body.

4. The assembly as recited in claim 1, wherein said cover is also mounted to said hinge for undergoing rotational movement between an open position where said cover is removable from said body and a closed position where said cover is secured onto said body.

5. The assembly as recited in claim 1, wherein said position retention means is at least one shoulder on said hinge which generally faces away from said body when said cover is located at said closed condition and toward said body when said cover is located adjacent to said open condition.

6. The assembly as recited in claim 5, wherein said shoulder is relatively concave in shape.

7. The assembly as recited in claim 5, wherein said shoulder is relatively arcuate in shape.

8. The assembly as recited in claim 1, wherein said position retention means is a pair of shoulders laterally spaced apart on said hinge which generally face away from said body when said cover is located at said closed condition and toward said body when said cover is located adjacent to said open condition.

9. The assembly as recited in claim 1, wherein said body includes a hinge mounting portion which has an end substantially cylindrical in shape and defining a passageway therethrough.

10. The assembly as recited in claim 9, wherein said hinge mounting portion of said body has a spring disposed within said passageway and being operable with said hinge for biasing said cover to said closed condition.

11. A receptacle assembly, comprising:

(a) a body adapted to receive a plug at one end;

(b) a cover;

(c) a hinge pivotally mounted to said body and having a bifurcated end, said hinge mounting said cover to undergo movement between an open condition and a closed condition relative to said body and biasing said cover toward said closed condition; and (d) a position retention means attached to said bifurcated end of said hinge for facilitating holding said cover adjacent to said open condition and blocking of movement of said cover to said closed condition when the plug is not present at said one end of said body, said bifurcated end of said hinge forming a pair of laterally spaced apart lugs each having a tab projecting peripherally outwardly therefrom and defining a shoulder such that said shoulders of said tabs and an adjacent portion of said body can retain a rod-shaped member therebetween for holding said cover adjacent to said open condition and blocking movement of said cover to said closed condition when the plug is not present at said one end of said body, said shoulders in conjunction with said hinge and said adjacent portion of said body form a channel-shaped gap closed along a bottom and open along a top thereof for receiving and supporting the rod-shaped member therein which, in turn, blocks pivotal movement of said hinge and thereby said cover to said closed condition.

12. The assembly as recited in claim 11, wherein said body is substantially cylindrical in shape and said cover is substantially circular in shape and has a diameter slightly greater than a diameter of said body for fitting said cover onto said body.

13. The assembly as recited in claim 11, wherein said cover is also mounted to said hinge for undergoing rotational movement between an open position where said cover is removable from said body and a closed position where said cover is secured onto said body.

14. The assembly as recited in claim 11, wherein said shoulders generally face away from said body when said cover is located at said closed condition and toward said body when said cover is located adjacent to said open condition.

15. The assembly as recited in claim 11, wherein said body includes a hinge mounting portion which has an end substantially cylindrical in shape and defining a passageway therethrough.

16. The assembly as recited in claim 15, wherein said hinge mounting portion of said body has a spring disposed within said passageway and being operable with said hinge for biasing said cover to said closed condition.

17. The assembly as recited in claim 11, wherein said shoulders are relatively concave in shape.

18. The assembly as recited in claim 11, wherein said shoulders are relatively arcuate in shape.

* * * * *